US008413575B2

(12) United States Patent
Schaum et al.

(10) Patent No.: US 8,413,575 B2
(45) Date of Patent: Apr. 9, 2013

(54) PRINTING UNIT OF A PRINTING MATERIAL PROCESSING MACHINE AND METHOD AND MACHINE FOR TREATING PRINTING MATERIAL

(75) Inventors: Frank Schaum, Neckargemünd (DE); Martin Schmitt-Lewen, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1057 days.

(21) Appl. No.: 12/056,768

(22) Filed: Mar. 27, 2008

(65) Prior Publication Data

US 2008/0236411 A1 Oct. 2, 2008

(30) Foreign Application Priority Data

Mar. 30, 2007 (DE) ..... 10 2007 015 844

(51) Int. Cl.
*B41F 19/02* (2006.01)
*B41F 19/08* (2006.01)
*B41M 1/24* (2006.01)

(52) U.S. Cl. ..... 101/23; 101/32

(58) Field of Classification Search ..... 101/23, 101/32; *B41F 19/02, 19/08; B41M 1/24*
See application file for complete search history.

(56) References Cited

U.S. PATENT DOCUMENTS 3,403,621 A * 10/1968 Hurwitz et al. ..... 101/23
3,513,772 A * 5/1970 Brasty ..... 101/23
5,123,343 A * 6/1992 Willer ..... 101/23
6,443,058 B1 9/2002 Stadler et al.
2007/0163455 A1 7/2007 Eitel et al.
2007/0212490 A1 9/2007 Preisner et al.
2007/0240590 A1 10/2007 Preisner et al.
2007/0243322 A1 10/2007 Preisner et al.
2007/0284047 A1 12/2007 Preisner et al.
2007/0296203 A1 12/2007 Golan
2008/0134912 A1 * 6/2008 Golan ..... 101/32

FOREIGN PATENT DOCUMENTS

DE 231760 A1 1/1986
DE 19826974 A1 12/1999
DE 10351868 A1 * 6/2005
DE 102005024153 A1 12/2006
DE 102005037494 A1 2/2007
DE 102005046229 A1 3/2007

(Continued)

OTHER PUBLICATIONS

German Search Report, dated Dec. 3, 2007.

*Primary Examiner* — Leslie J Evanisko
(74) *Attorney, Agent, or Firm* — Laurence A. Greenberg; Werner H. Stemer; Ralph E. Locher

(57) ABSTRACT

A printing unit of a printing material processing machine, preferably a sheetfed offset printing press, includes a form cylinder and an impression cylinder. The form cylinder has a printing form for applying printed information to the printing material and the impression cylinder has a microstructured surface, preferably a cover, contacting the printing material. A surface of the impression cylinder contacting the printing material is provided with micro-embossed structures for applying embossed information to the printing material. The printing material is printed and embossed simultaneously. A security feature and/or a change in gloss can be implemented on the printed product through the use of the embossed, preferably micro-embossed, information.

17 Claims, 1 Drawing Sheet

FOREIGN PATENT DOCUMENTS

| | | | | |
|---|---|---|---|---|
| EP | 1022134 | A1 | | 7/2000 |
| GB | 2360743 | A | * | 10/2001 |
| JP | 02112941 | A | | 4/1990 |
| JP | 03120048 | A | | 5/1991 |
| JP | 04070340 | A | | 3/1992 |
| JP | 2000280598 | A | | 10/2000 |
| WO | 2004096570 | A2 | | 11/2004 |
| WO | 2005100025 | A1 | | 10/2005 |
| WO | 2006112696 | A2 | | 10/2006 |
| WO | 2007028557 | A1 | | 3/2007 |

* cited by examiner

PRINTING UNIT OF A PRINTING MATERIAL PROCESSING MACHINE AND METHOD AND MACHINE FOR TREATING PRINTING MATERIAL

CROSS-REFERENCE TO RELATED APPLICATION

This application claims the priority, under 35 U.S.C. §119, of German Patent Application DE 10 2007 015 844.2, filed Mar. 30, 2007; the prior application is herewith incorporated by reference in its entirety.

BACKGROUND OF THE INVENTION

Field of the Invention

The present invention relates to a printing unit of a printing material processing machine, including a form cylinder and an impression cylinder. The form cylinder has a printing form for applying printed information to the printing material and the impression cylinder has a microstructured surface contacting the printing material. Furthermore, the present invention relates to a method and a machine for treating printing material.

It is known from the prior art to process printed products with separate embossing devices after printing and to produce embossed patterns in the process. Such embossed patterns may be visible and thus change the external appearance of the printed product. Furthermore, such embossed patterns may also be invisible and thus constitute what are known as security features (steganographic features) on printed products, which can only be registered with the aid of decoders. Security features are used primarily for the detection of forgeries, for example in the printing of documents of value or else on the packaging of expensive products such as medicaments or perfumes.

German Published, Non-Prosecuted Patent Application DE 198 26 974 A1 discloses a finishing unit or an embossing apparatus for optically increasing the value of printing materials previously printed in printing units, having a cylinder for carrying an embossing form and a cylinder for carrying a resilient impression support or embossing support. The embossing form can be clamped on a form cylinder or on an impression cylinder. The embossing support can be clamped on an impression cylinder or a form cylinder in a corresponding way. The two processes, printing and embossing, are carried out in separate apparatuses.

International Application No. WO 2005/100025 A1, corresponding to U.S. Patent Application Publication Nos. US 2007/0284047A1; US 2007/0243322 A1; US 2007/0240590; US 2007/0212490; and US 2007/0163455 A1, discloses an embossing apparatus for film coating, having an impression cylinder and a press roll, which is provided with a finely structured cover. The structure can have a base structure of small glass spheres lying at the same height and surface elements differing from the base structure, which means that desired (visible) structural effects can be produced on the surface of the film coating. The processes of printing and film coating/embossing are carried out separately.

International Application No. WO 2004/096570 A2, corresponding to U.S. Patent Application Publication No. US 2007/0296203A1, discloses a method and an apparatus for the production of what are known as hidden images (concealed, latent images/information that cannot be perceived by the human eye) on printing materials. The apparatus has an engraved roll and an opposing roll, possibly likewise engraved, with the hidden image being impressed into the printing material by the engraving. The hidden image can be made visible to the human eye through the use of a decoder. The engraving can be provided as an embossing form on a cylinder.

It is possible to observe continual endeavors to develop novel features in the area of the application of security features. High security against forgery can often be achieved only by the application of a number of security features.

BRIEF SUMMARY OF THE INVENTION

It is accordingly an object of the invention to provide a printing unit of a printing material processing machine and a method and a machine for treating printing material, which overcome the hereinafore-mentioned disadvantages of the heretofore-known devices and methods of this general type, which are improved as compared with the prior art and which allow the production of embossed patterns while avoiding costly re-equipping of machines and time-consuming procedures.

With the foregoing and other objects in view there is provided, in accordance with the invention, a printing unit of a printing material processing machine. The printing unit comprises a form cylinder having a printing form for applying printed information to the printing material, and an impression cylinder having a microstructured surface contacting the printing material. The microstructured surface making contact with the printing material has micro-embossing structures for applying embossing information to the printing material.

According to the invention, the printing material is embossed by using the surface of the impression cylinder, with micro-embossing structures being provided on the surface of the impression cylinder. The embossing is thus advantageously carried out in the printing unit and not in a separate embossing device, so that costly separate embossing apparatuses can be avoided. Instead, the surface of the impression cylinder is configured for the embossing.

In accordance with another feature of the apparatus according to the invention, which is advantageous with regard to minimizing costs and is therefore preferred, the surface of the impression cylinder that makes contact with the printing material is formed by a cylinder cover. Such a cover can be produced inexpensively by known methods and stretched onto an impression cylinder. The re-equipment of the machine can therefore advantageously be carried out in a short time. The replacement of embossing cylinders is dispensed with.

With the objects of the invention in view, there is also provided a method for treating a printing material. The method comprises substantially simultaneously providing a first side of the printing material with printed information and a second side of the printing material with embossed information.

According to the invention, the printing and embossing are carried out substantially simultaneously, which is to say the printing material is printed on one side and embossed on the other side, at least in some sections. This procedure can be carried out in one and the same printing unit, so that both time and equipment can be saved. These both advantageously lead to the reduced cost of production of printed products having embossed features.

In accordance with another mode of the method of the invention, which is advantageous with regard to the printing process and is therefore preferred, the printing material is printed on the first side by lithographic offset printing.

In accordance with a further mode of the method of the invention, which is advantageous with regard to the intended use of the embossed structure and is therefore preferred, the printing material is embossed on the second side by using a microstructure. Microstructures can advantageously be used for the production of concealed security features.

In accordance with an added mode of the method of the invention, which is advantageous with regard to the embossed results and time savings, before the application of the embossed information, the second side is provided with printed information and the printing material is turned before the application of the embossed information. In this way, during the verso printing operation, it is possible to impress into the not yet completely dry ink from a recto printing operation.

In accordance with an additional mode of the method of the invention, which is advantageous with regard to the security aspect and is therefore preferred, the embossed information changes the surface of the printing material or an ink layer on the surface of the printing material in a manner which cannot be perceived by the human eye.

In accordance with yet another mode of the method of the invention, which is advantageous with regard to the decorative finishing of printed products and is therefore preferred, the embossed information changes the surface of the printing material or an ink layer on the surface of the printing material in a manner which can be perceived by the human eye.

With the objects of the invention in view, there is furthermore provided a printing material processing machine, in particular a printing press or a sheet-processing rotary printing press for lithographic offset printing, comprising at least one printing unit according to the invention.

In accordance with a concomitant feature of the invention, the printing unit according to the invention is preferably disposed downstream of a further printing unit and a turning device, in a printing material transport direction.

The machine for processing printing material is preferably a sheet-processing rotary printing press for lithographic offset printing, in particular wet offset printing. The printing material can be board, film or preferably paper. The printing press can be operated in recto printing mode or preferably perfecting mode. The printing press can provide the printing material with single-color or preferably multicolor printed images. As seen in the printing material transport direction, the printing press can have a feeder, a feed table, a plurality of printing units, a turning device, further printing units, a varnishing unit, a dryer, a powdering apparatus and/or a delivery. The printing press can include an operating desk and a control unit.

Other features which are considered as characteristic for the invention are set forth in the appended claims.

Although the invention and further structurally and functionally advantageous developments of the invention are illustrated and described herein as embodied in a printing unit of a printing material processing machine and a method and a machine for treating printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, noting that the invention and advantageous developments thereof described herein also constitute advantageous developments of the invention in any desired combination with one another.

DETAILED DESCRIPTION OF THE INVENTION

Figure 1:
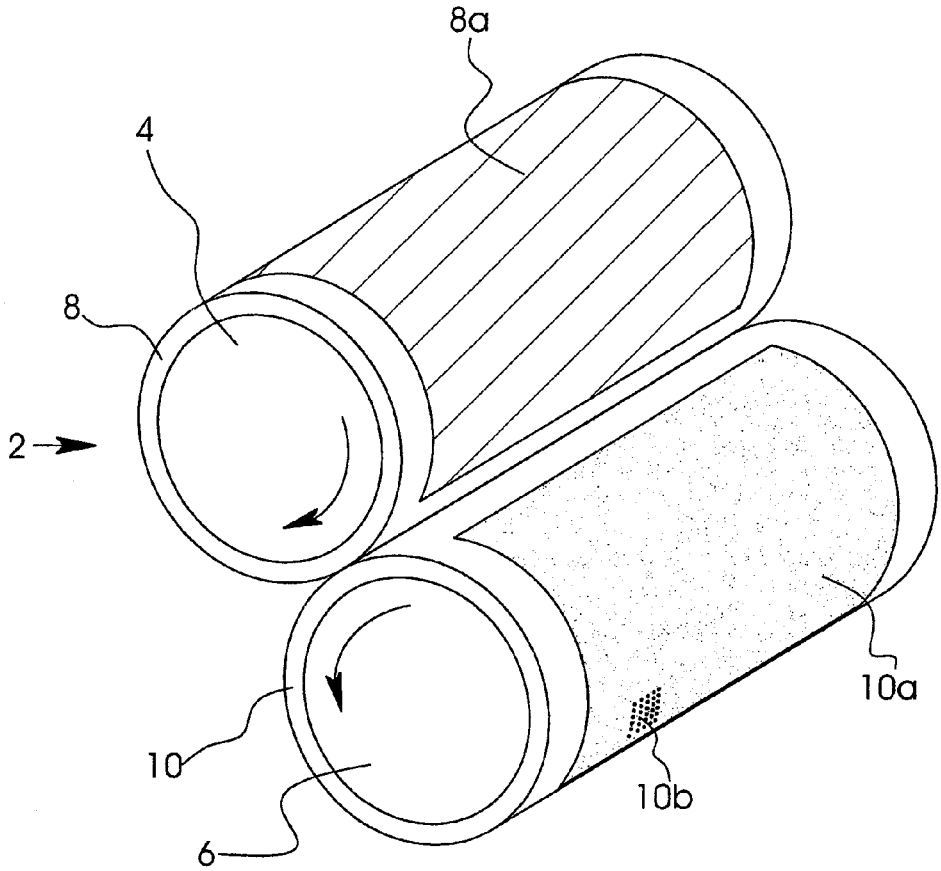
FIG. 1 is a diagrammatic, perspective view of an exemplary embodiment of a printing unit according to the invention.

Referring now to the figures of the drawings in detail and first, particularly, to FIG. 1 thereof, there is seen a printing unit 2 according to the invention, which belongs to a printing press 1 (see FIG. 3), is preferably a printing unit for lithographic offset printing and for processing sheet printing material, such as paper sheets, and has a printing form cylinder 4 and an impression cylinder 6. The printing form cylinder 4 carries a printing form 8, preferably a printing plate which is flexible and can be clamped on or a printing sleeve. The impression cylinder 6 carries a cover 10 making contact with printing material, in particular carrying printing material, preferably a flexible metal sheet (aluminum or stainless steel) or a film. Alternatively, provision can be made for the printing form 8 to be formed directly on the surface of the printing form cylinder 4 itself. Furthermore, instead of a cover 10, provision can be made for the surface of the impression cylinder 6 itself to form a surface making contact with printing material, in particular carrying printing material.

The printing form 8 has a printing image 8*a* which contains information that is transferred to a printing material as what is known as printed information. Furthermore, the cover 10 has a structured, preferably microstructured, area 10*a*, which is to say an area having elevations with a height and spacings preferably being in the micrometer range. For example, the elevations can be between about 10 and about 100 micrometers high and spaced apart from one another by between about 10 and about 500 micrometers. Preference is given to elevations, on average, of about 20 micrometers in height and, on average, about 200 micrometers in mutual spacing.

A printing material 12 (see FIG. 2 as well), preferably a sheet, is conveyed through a press nip between the two cylinders 4 and 6 and, in the process, provided by the printing from cylinder 4 with printing ink or varnish on a first side 12*a* (an upper side in this exemplary embodiment) and thus with printed information (text, image, pattern, etc.). An underside or the second side of the sheet can be printed by an upstream printing unit 20 of the printing press 1 (see also FIG. 3 as well), which is to say provided with printed information, and the printing material 12 can be turned.

According to the invention, the microstructured area 10*a* not only has preferably stochastic micro structuring but also information to be embossed (text, image, pattern, etc.) which is preferably non-stochastic. The surface of the impression cylinder 6 that makes contact with the printing material is therefore provided in some sections with micro embossing structures 10*b* (shown in an enlarged illustration in FIG. 1 for clarification) for the application of embossed information to the printing material 12. These micro embossing structures 10*b* can be formed by the same micro elevations (same production, same material, same shape, etc.) as the microstructured area 10*a*. Provision can be made to place the elevations of the micro embossing structures 10*b* of the information to be embossed in an appropriate manner, while the other elevations of the microstructured area 10*a* are preferably disposed stochastically. The production of such structured areas can be carried out in accordance with the process disclosed in International Application No. WO 2006/112696 through the use of galvanic molding. With that process, it is possible to place the configuration of the elevations in a specific manner and consequently to place information to be embossed in the microstructured area 10*a*. For example, a micro text, a micro image or micro pattern can be disposed in a concealed manner in the stochastically distributed "peaks" of micro elevations. A company logo or a number or bar code would be conceivable. Such information can be present in rastered form and differs from a surrounding raster, so that the information can be registered with a decoder matched to the raster.

According to the invention, the first side 12*a* is thus provided with printed information and, substantially simultaneously, the second side 12*b* of the printing material 12 is provided with embossed information. In this case, provision is preferably made for the embossed information to change the surface of the printing material 12 or an ink layer on the surface of the printing material 12 in a manner which cannot be perceived by the human eye, which means that the embossed information constitutes what is known as a hidden image (a concealed image that cannot be perceived by the human eye). For example, a hidden image can be impressed into a full-tone area. Through the use of a known decoder, for example by using what is known as the Moiré effect, the hidden image can, however, also be made visible to the human eye. To this extent, according to the invention, a printed product can be equipped with a security feature during the production of the print. No complicated apparatus is necessary for this purpose, merely a cover 10 prepared in accordance with the information to be embossed.

Alternatively, provision can be made for the embossed information to change the surface of the printing material 12 or an ink layer on the surface of the printing material in a manner that can be perceived by the human eye, which is to say that the appearance of the printed product produced is changed. For example, a matt-gloss effect can be produced by changing a matt-gloss effect of the printing material 12 specifically by the information to be embossed. For example, through the use of the micro-embossed information, a reduction in gloss can be brought about if those embossed structures which have a matting effect are chosen. The influencing of the gloss can also be used as a security feature besides the use for decorative purposes.

Figure 2:
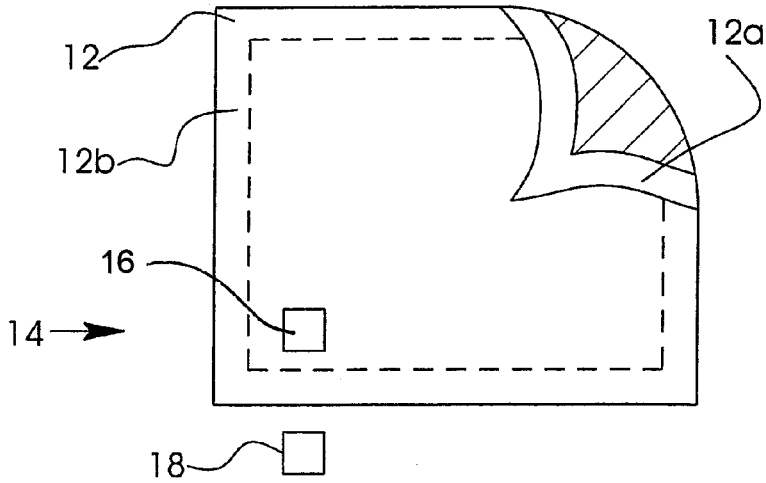
FIG. 2 is a plan view of a printed product produced in accordance with the invention.

FIG. 2 shows a printed product 14 produced by the method according to the invention, having the first side 12*a* and the second side 12*b*. On the second side 12*b*, a region of the printing material 12 with which contact is made by the microstructured area 10*a* is illustrated with dashed lines. In this region, a section 16 is illustrated in which concealed information has been applied by the micro embossing structures 10*b*. Such information can be located on an outer side on the finished product, for example a folded box, so that an inspector with a decoder 18 can check the authenticity of the printed folded box, for example a pharmaceutical pack. Alternatively, the embossed information can be distributed over the printing material 12, registered by a scanner and evaluated by a computer.

Figure 3:
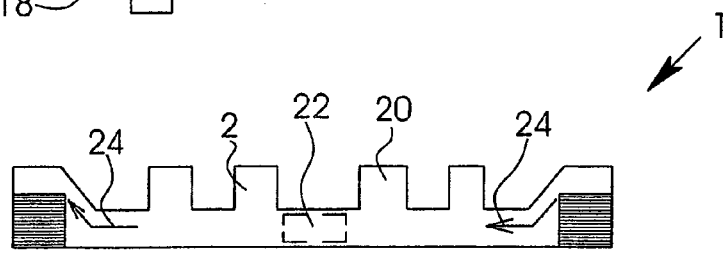
FIG. 3 is a side-elevational view of a printing press according to the invention.

FIG. 3 shows the printing press 1, specifically a sheetfed printing press, having the printing unit 2 according to the invention, the printing unit 20 disposed upstream in a printing material transport direction 24 as well as a turning device 22 for turning the sheets. Through the use of this configuration and by using the micro embossing structures 10*b*, it is possible to impress directly into ink that is still fresh, that is to say not yet dried or not yet completely dried ink, and as a result in particular for a specific matt-gloss effect or a specific gloss modification to be achieved.

Since it is customary for impression cylinder covers 10, as opposed to printing forms 8, to remain clamped on over many print jobs, many different printed products can be provided with the same embossed information which then, in a way, functions as a "fingerprint" of the printing press, which means that the printing press used during the production of the printed product can be determined through the embossed information. Alternatively, the covers 10 can also be changed if a new print job is to be carried out with new embossed information. Advantageously, already installed presses can be used for the production of printed products with micro-embossed information through employing covers that are changed in accordance with the invention. Costly re-equipment of machines is not necessary.

Alternatively, it is also possible to provide a printing unit according to the invention separately and to supply the latter with printed products produced in a printing press, which are then treated in accordance with the invention.

In a further application of the invention, it is possible to use micro-embossed information to specifically change the surface of the printing material. For example, adhesive tabs can be surface-treated in order to have a positive influence on their adhesive capability.

The invention claimed is:

1. A printing unit of a printing material processing machine, the printing unit comprising:

a form cylinder having a printing form for applying printed information to the printing material; and an impression cylinder having a microstructured surface contacting the printing material, said microstructured surface contacting the printing material having stochastic micro-structures for contacting and carrying the printing material and non-stochastic micro-embossing structures for applying embossed information to the printing material, said non-stochastic micro-embossing structures and said stochastic micro-structures being formed by the same micro-elevations.

2. The printing unit according to claim 1, wherein said microstructured surface of said impression cylinder contacting the printing material is formed by a cylinder cover.

3. The printing unit according to claim 1, wherein said non-stochastic micro-embossing structures are formed by the same production as said stochastic micro-structures.

4. The printing unit according to claim 1, wherein said non-stochastic micro-embossing structures are formed of the same material as said stochastic micro-structures.

5. The printing unit according to claim 1, wherein said non-stochastic micro-embossing structures have the same shape as said stochastic micro-structures.

6. A method for treating a printing material, the method comprising the following steps:

providing the printing unit according to claim 1;

substantially simultaneously providing a first side of the printing material with printed information and a second side of the printing material with embossed information.

7. The method according to claim 6, which further comprises printing the printing material on the first side by lithographic offset printing.

8. The method according to claim 6, which further comprises embossing the printing material on the second side by using the non-stochastic micro-embossing structures.

9. The method according to claim 6, which further comprises providing the second side of the printing material with printed information and turning the printing material, before applying the embossed information.

10. The method according to claim 6, which further comprises changing a surface of the printing material or an ink layer on the surface of the printing material with the embossed information, in a manner imperceptible by the human eye.

11. The method according to claim 6, which further comprises changing the surface of the printing material or an ink layer on the surface of the printing material with the embossed information, in a manner perceptible by the human eye.

12. A printing material processing machine, comprising a printing unit according to claim 1.

13. The printing material processing machine according to claim 12, which further comprises:

a further printing unit; and a turning device;

said printing unit being disposed downstream of said further printing unit and said turning device in a printing material transport direction.

14. A printing press, comprising a printing unit according to claim 1.

15. The printing press according to claim 14, which further comprises:

a further printing unit; and a turning device;

said printing unit being disposed downstream of said further printing unit and said turning device in a printing material transport direction.

16. A sheet-processing rotary printing press for lithographic offset printing, the printing press comprising a printing unit according to claim 1.

17. The sheet-processing rotary printing press for lithographic offset printing according to claim 16, which further comprises:

a further printing unit; and a turning device;

said printing unit being disposed downstream of said further printing unit and said turning device in a printing material transport direction.

* * * * *